US009721502B2

(12) United States Patent
Bi et al.

(10) Patent No.: US 9,721,502 B2
(45) Date of Patent: Aug. 1, 2017

(54) ORGANIC LIGHT-EMITTING DIODE DISPLAY WITH COMPENSATION FOR TRANSISTOR VARIATIONS

(71) Applicant: Apple Inc., Cupertino, CA (US)

(72) Inventors: Yafei Bi, Palo Alto, CA (US); Wei H. Yao, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 52 days.

(21) Appl. No.: 14/500,738

(22) Filed: Sep. 29, 2014

(65) Prior Publication Data

US 2015/0294626 A1 Oct. 15, 2015

Related U.S. Application Data

(60) Provisional application No. 61/979,165, filed on Apr. 14, 2014.

(51) Int. Cl.
*G09G 3/32* (2016.01)
*G09G 3/3233* (2016.01)

(52) U.S. Cl.
CPC ... *G09G 3/3233* (2013.01); *G09G 2320/0285* (2013.01); *G09G 2320/0295* (2013.01); *G09G 2320/043* (2013.01)

(58) Field of Classification Search
CPC ..... G09G 3/32; G09G 3/3292
USPC ..... 345/156–184, 204
See application file for complete search history.

(56) References Cited

U.S. PATENT DOCUMENTS

| | | | | |
|---|---|---|---|---|
| 8,497,854 | B2 | 7/2013 | Ogura | |
| 2011/0018858 | A1* | 1/2011 | Ryu | G09G 3/3233 345/213 |
| 2014/0092076 | A1 | 4/2014 | Lee | |
| 2014/0177182 | A1 | 6/2014 | Cho | |
| 2014/0198092 | A1* | 7/2014 | Azizi | G09G 3/006 345/212 |
| 2014/0347253 | A1* | 11/2014 | Lee | H05B 33/0896 345/76 |

* cited by examiner

*Primary Examiner* — Carolyn R Edwards
(74) *Attorney, Agent, or Firm* — Treyz Law Group, P.C.; Michael H. Lyons

(57) ABSTRACT

A display may include an array of organic light-emitting diode display pixels having transistors characterized by threshold voltages subject to transistor variations. Compensation circuitry may be used to measure at transistor threshold voltage for a pixel. The threshold voltage may be sampled by controlling the pixel to sample the threshold voltage onto a capacitor at the pixel. The compensation circuitry may include sense circuitry that may be operated in combination with the pixel to transfer charge from the capacitor to the sense circuitry such that the threshold voltage is produced at an output of the sense circuitry. The compensation circuitry may generate compensation data based on the measured threshold voltage. During display operations, data circuitry may receive digital image data and process the digital image data along with the compensation data to generate analog data signals for the pixel.

18 Claims, 8 Drawing Sheets

ORGANIC LIGHT-EMITTING DIODE DISPLAY WITH COMPENSATION FOR TRANSISTOR VARIATIONS

This application claims the benefit of provisional patent application No. 61/979,165, filed Apr. 14, 2014 which is hereby incorporated by reference herein in its entirety.

BACKGROUND

This relates generally to electronic devices with displays and, more particularly, to display driver circuitry for displays such as organic-light-emitting diode displays.

Electronic devices often include displays. For example, cellular telephones and portable computers include displays for presenting information to users.

Displays such as organic light-emitting diode displays have an array of display pixels based on light-emitting diodes. In this type of display, each display pixel includes a light-emitting diode and thin-film transistors for controlling application of a signal to the light-emitting diode to produce light.

An organic light-emitting diode display pixel includes a drive thin-film transistor connected to a data line via an access thin-film transistor. The access transistor may have a gate terminal that receives a scan signal via a corresponding, scan line. Barrage data on the data line can be loaded into the display pixel b asserting the scan signal to turn on the access transistor. The display pixel includes a current source transistor that provides current to the organic light-emitting diode to produce light.

Transistors in an organic light-emitting diode display pixel may be subject to manufacturing variations or operating variations. Due to such variations, transistor threshold voltages between different display pixels may vary. Variations in transistor threshold voltages can cause the display pixels to produce amounts of light that do not match a desired image. Compensation schemes are sometimes used to compensate for variations in threshold voltage. Such compensation schemes typically involve sampling operations that are performed during normal display operations and increase the time required to display images.

It would therefore be desirable to be able to provide improved displays such as improved organic light-emitting diode displays.

SUMMARY

An electronic device may include a display having an array of display pixels. The display pixels may be organic light-emitting diode display pixels. Each display pixel may have an organic light-emitting diode that emits light. A drive transistor a current source transistor) in each display pixel may apply current to the organic light-emitting diode in that display pixel. The drive transistor may be characterized by a threshold voltage.

The threshold voltage may be subject to transistor variations. Compensation circuitry may be used to measure the threshold voltage of the current source transistor. The threshold voltage may be sampled by controlling the current source transistor to sample the threshold voltage onto a capacitor coupled between gate and source terminals of the current source transistor. The compensation circuitry may include sense circuitry that may be operated in combination with the pixel to transfer charge from the capacitor to the sense circuitry such that the threshold voltage is produced at an output of the sense circuitry. The compensation circuitry may generate compensation data based on the measured threshold voltage. During display operations, data circuitry may receive digital image data and process the digital image data along with the compensation data to generate analog data signals for the pixel.

Threshold voltage compensation data may be generated for each pixel or for groups of pixels. The compensation data may be stored in memory such as volatile or non-volatile memory. The compensation data may be stored as an offset value (e.g., normalized against a reference threshold voltage). During display operations, data circuitry may add the offset value to the digital image data. The summed digital value may be used in generating analog pixel data signals that compensates for threshold voltage variations between pixels.

DETAILED DESCRIPTION

Figure 1:
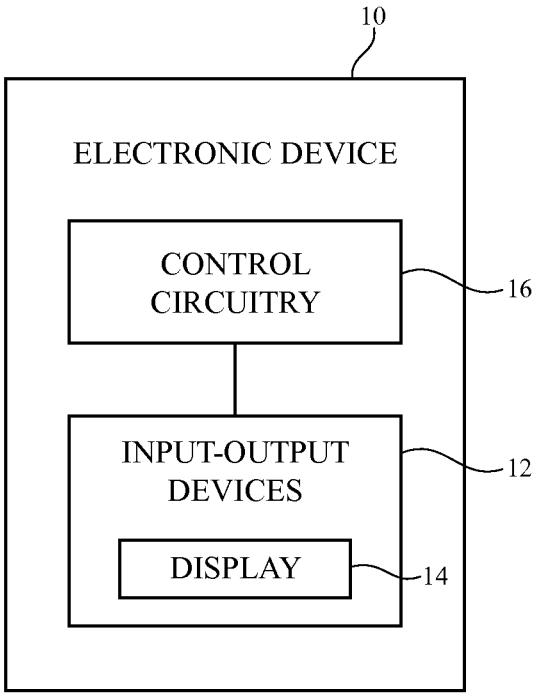
FIG. 1 is a diagram of an illustrative electronic device having a display in accordance with an embodiment.

An illustrative electronic device of the type that may be provided with an organic light-emitting diode (OLED) display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio codec chips, application specific integrated circuits, programmable integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, click wheels, scrolling wheels, touch pads, key pads, keyboards, microphones, speakers, tone generators, vibrators, cameras, sensors, light-emitting diodes and other status indicators data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device the software running on control circuitry 16 may display images on display 14 in input-output devices.

Figure 2:
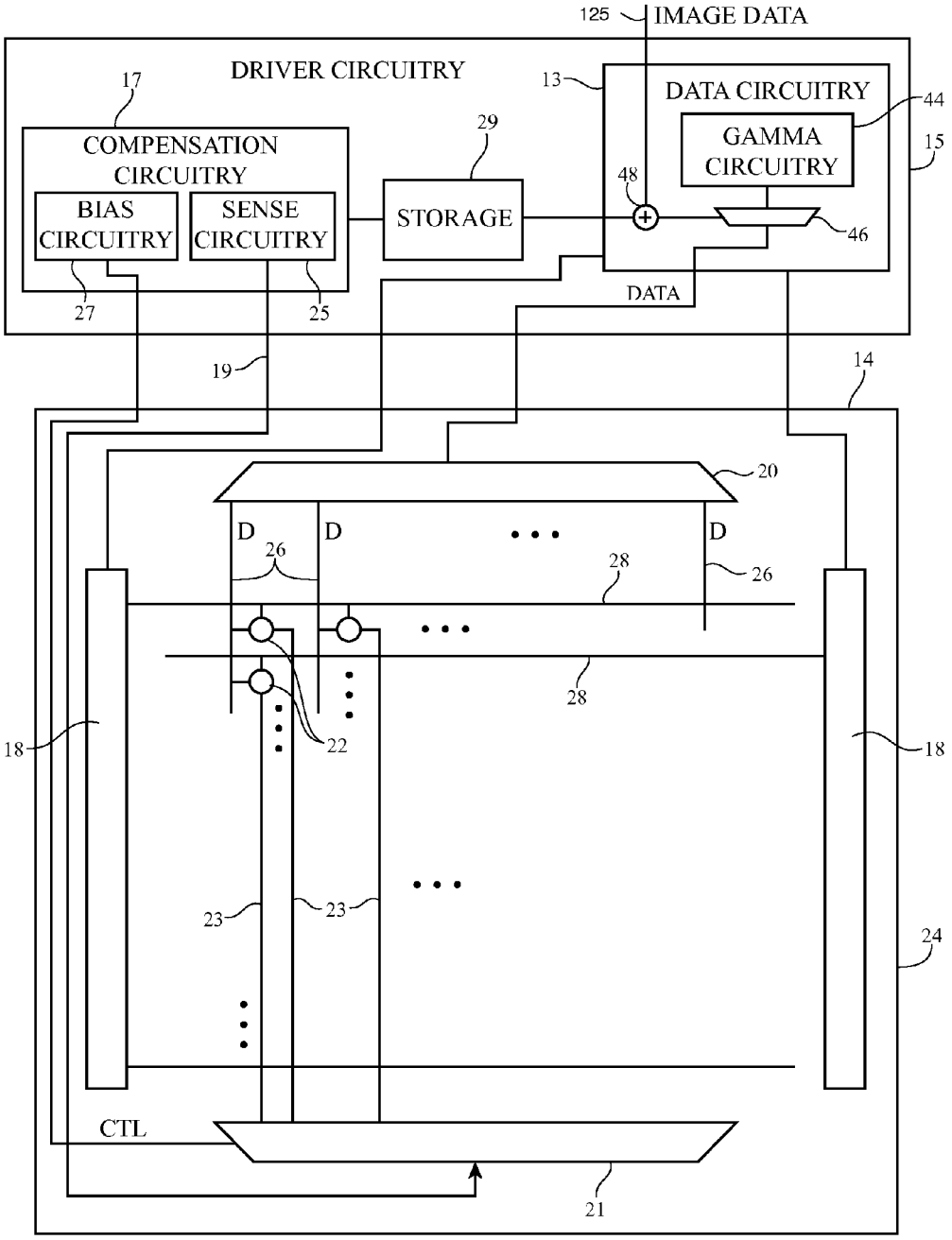
FIG. 2 is a diagram of an illustrative display such as an organic light-emitting diode display having, an array of organic light-emitting diode display pixels in accordance with an embodiment.

FIG. 2 shows display 14 and associated display driver circuitry 15. Display 14 includes structures formed on one or more layers such as substrate 24. Layers such as substrate 24 may be formed from planar rectangular layers of material such as planar glass layers. Display 14 may have an array of display pixels 22 for displaying images for a user. The array of display pixels 22 may be formed from rows and columns of display pixel structures on substrate 24. These structures may include thin-film transistors such as polysilicon thin-film transistors, semiconducting oxide thin-film transistors, etc. There may be any suitable number of rows and columns in the array of display pixels 22 (e.g., ten or more, one hundred or more, or one thousand or more).

Display driver circuitry such as display driver integrated circuit 15 may be coupled to conductive paths such as metal traces on substrate 24 using solder or conductive adhesive. If desired display driver integrated circuit 15 may be coupled to substrate 24 over a path such as a flexible printed circuit or other cable. Display driver integrated circuit 15 (sometimes referred to as a timing controller chip) may contain communications circuitry for communicating with system control circuitry 16 over path 125. Path 125 may be formed from traces on a flexible printed circuit or other cable. The control circuitry may be located on a main logic board in an electronic device such as a cellular telephone, computer, television, set-top box, media player, portable electronic device, or other electronic equipment in which display 14 is being used. During operation, the control circuitry may supply display driver integrated circuit 15 with information on images to be displayed on display 14. To display the images on display pixels 22, display driver integrated circuit 15 may supply clock signals and other control signals to display driver circuitry such as row driver circuitry 18 and column driver circuitry 20. For example, data circuitry 13 may receive image data and process the image data to provide pixel data signals to display 14. The pixel data signals may be demultiplexed by circuitry 20 and pixel data signals D may be routed to each pixel 22 over data lines 26 (e.g., each red, green, or blue pixel). Row driver circuitry 18 and/or column driver circuitry 20 may be formed from one or more integrated circuits and/or one or more thin-film transistor circuits.

Display driver integrated circuit 15 may include compensation circuitry 17 that helps to compensate for variations between pixels 22 such as threshold voltage variations. Compensation circuitry 17 may, if desired, help compensate for transistor aging. Compensation circuitry 17 may be coupled to pixels 22 via path 19, switching circuitry 21, and paths 23. Compensation circuitry 17 may include sense circuitry 25 and bias circuitry 27. Sense circuitry 25 may be used in sensing (e.g. sampling) voltages from pixels 22. During sense operations, switching circuitry 21 may be configured to electrically couple sense circuitry 25 to one or more selected pixels 22. For example, compensation circuitry 17 may produce control signal CTL to configure switching circuitry 21. Sense circuitry 25 may sample voltages such as threshold voltages or other desired signals from the pixels over path 19, switching circuitry 21, and paths 23. Bias circuitry 27 may include one or more driver circuits for driving reference or bias voltages onto nodes of pixels 22. For example, switching circuitry 21 may be configured to electrically couple path 19 to one or more selected pixels 22. In this scenario, bias circuitry 27 may provide reference signals to the selected pixels. The reference signals may bias nodes at the selected pixels at desired voltages for sensing operations performed by sense circuitry 25.

Compensation circuitry 17 may perform compensation operations on pixels 22 using bias circuitry 27 and sense circuitry 25 to generate compensation data that is stored in storage 29. Storage 29 may, for example, be static random access memory (SRAM). In the example of FIG. 2, storage 29 is on-chip storage. If desired, storage 29 may be off-chip storage such as non-volatile storage (e.g., non-volatile memory that maintains stored information even when powered off). The compensation data stored in storage 29 may be retrieved by data circuitry 13 during display operations. Data circuitry 13 may process the compensation data along with incoming digital image data to generate compensated data signals for pixels 22.

In the example of FIG. 2, data circuitry 13 includes gamma circuitry 44 that provides a mapping of digital image data to analog data signals at appropriate voltage levels for driving pixels 22. Multiplexer 46 receives a set of possible analog data signals from gamma circuitry 44 and is controlled by the digital image data to select an appropriate analog data signal for the digital image data. Compensation data retrieved from storage 29 may be added to the digital image data by adder circuit 48 to help compensate for transistor variations between different pixels.

The example of FIG. 2 in which compensation data is added as an offset to digital input image data is merely illustrative. In general, data circuitry 13 may process compensation data along with image data to produce compensated analog data signals for driving pixels 22.

Row driver circuitry 18 may be located on the left and right edges of display 14, on only a single edge of display 14 or elsewhere in display 14. During operation, row driver circuitry 18 may provide rosy control signals on horizontal lines 28 (sometimes referred to as row lines or "scan" lines). Row driver circuitry may sometimes be referred to as scan line driver circuitry.

Demultiplexing circuitry 20 may be used to provide data signals D from display driver integrated circuit 15 onto a plurality of corresponding vertical lines 26. Demultiplexing circuitry 20 may sometimes be referred to as column driver circuitry, data line driver circuitry, or source driver circuitry. Vertical lines 26 are sometimes referred to as data lines. During display operations, display data is loaded into display pixels using lines 26.

Each data line 26 is associated with a respective column of display pixels 22. Sets of horizontal signal lines 28 run horizontally through display 14. Each set of horizontal signal lines 28 is associated with a respective row of display pixels 22. The number of horizontal signal lines in each row is determined by the number of transistors in the display pixels 22 that are being controlled independently by the horizontal signal lines. Display pixels of different configurations may be operated by different numbers of scan lines.

Row driver circuitry 18 may assert control signals such as scan signals on the row lines 28 in display 14. For example, driver circuitry 18 may receive clock signals and other control signals from display driver integrated circuit 15 and may in response to the received signals, assert scan signals and an emission signal in each row of display pixels 22. Rows of display pixels 22 may be processed in sequence, with processing for each frame of image data starting at the top of the array of display pixels and ending at the bottom of the array (as an example). While the scan lines in a row are being asserted, control signals and data signals that are provided to column driver circuitry 20 by circuitry 15 direct circuitry 20 to demultiplex and drive associated data signals D (e.g., compensated data signals provided by data circuitry 13) onto data lines 26 so that the display pixels in the row will be programmed with the display data appearing on the data lines D. The display pixels can then display the loaded display data.

Figure 3:
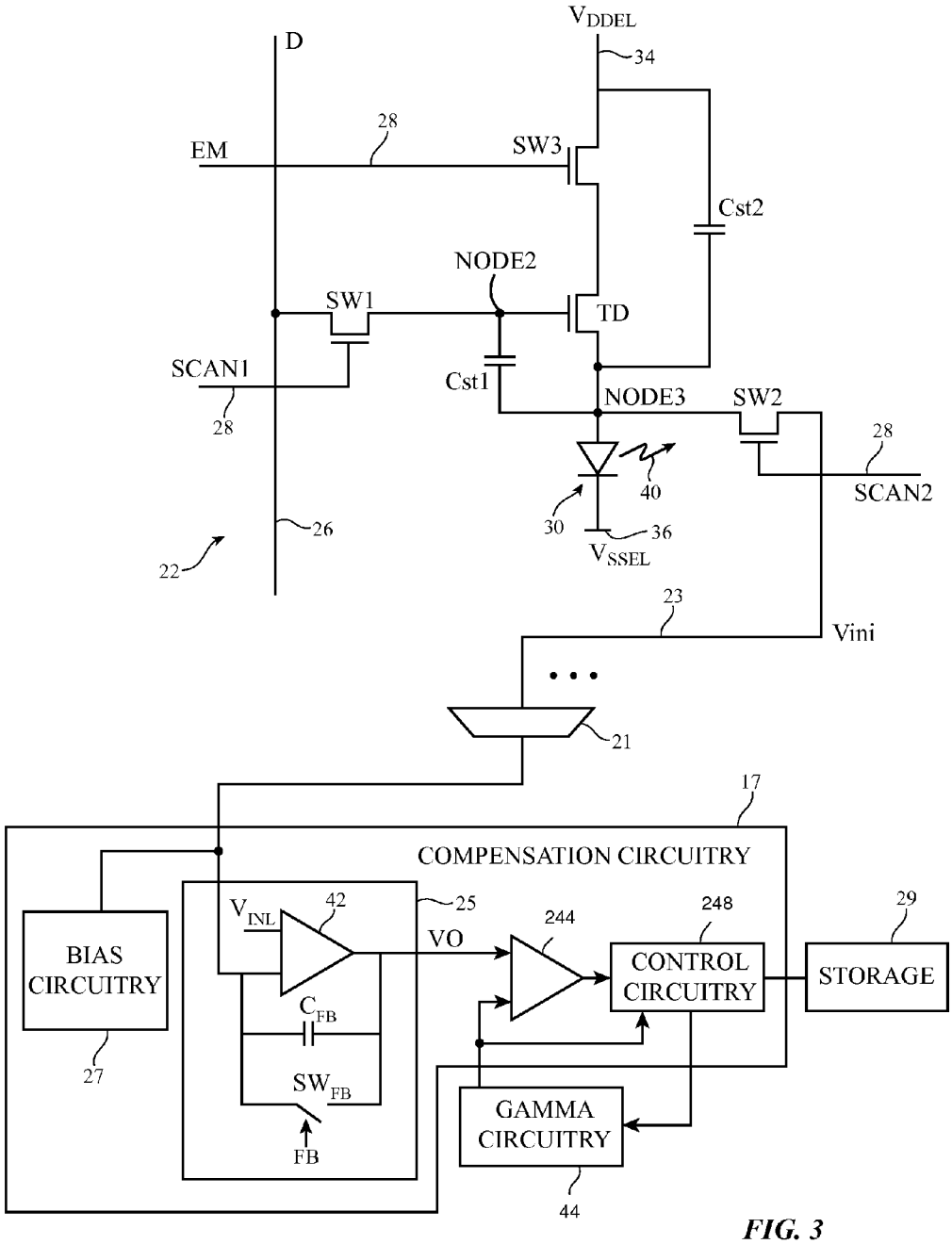
FIG. 3 is a diagram of an illustrative organic light-emitting diode display pixel that is coupled to compensation circuitry in accordance with an embodiment.

In an organic light-emitting diode display, each display pixel contains a respective organic light-emitting diode. A schematic diagram of an illustrative organic, light-emitting diode display pixel 22 that is coupled to compensation circuitry 17 is shown in FIG. 3. As shown in FIG. 3, display pixel 22 may include a light-emitting diode 30 coupled to a drive transistor TD. A positive power supply voltage $V_{DDEL}$ may be supplied to positive power supply terminal 34, whereas a ground power supply voltage $V_{SSEL}$ may be supplied to ground power supply terminal 36. The state of drive transistor TD controls the amount of current flowing through diode 30 and therefore the amount of emitted light 40 from display pixel 22. Drive transistor TD may sometimes be referred to as a current source transistor, because transistor TD sources current for diode 30.

Display pixel 22 may have storage capacitors CST1 and CST2 and one or more transistors that are used as switches such as transistors SW1, SW2, and SW3. Signal EM and scan signals SCAN1 and SCAN2 are provided to a row of display pixels 22 using row lines 28. Data D is provided to a column of display pixels 22 via data lines 26.

Signal EM is used to control the operation of emission transistor SW3. Transistor SW1 is used to apply the voltage of data line 26 to node NODE2, which is connected to the gate of drive transistor TD. Transistor SW2 is controlled to electrically couple node NODE3 to path 23 during compensation operations. Bias circuitry 27 at compensation circuitry 17 may apply a direct current (DC) bias voltage Vini to node NODE3 for circuit initialization during compensation operations, whereas the voltage at node NODE3 may be conveyed to sense circuitry 25 for sampling. As shown in FIG. 3, sense circuitry 25 may include amplifier 42 (e.g., an operational amplifier) that receives reference voltage VR at a first input node. Feedback circuitry including feedback capacitor CFB and switch SWFB are coupled between a second input node and the output of amplifier 42. Compensation circuitry 17 may include amplifier 244 that receives the sense output signal from sense circuitry 25 and a gamma level signal from gamma circuitry 44. Amplifier 244 may serve as a comparator that compares the sense output signal to the gamma level signal to produce a comparator output signal. Control circuitry 248 may use the comparator output signal and control the gamma level signal produced by gamma circuitry 44 in generating compensation data for storing in storage 29. Gamma circuitry 44 may be a digital-to-analog converter, sometimes referred to as a gamma reference block, that is used to convert digital display data (e.g., gray level values) to analog display data (e.g., voltage signals corresponding to desired luminance values). For example, gamma circuitry 44 may form part of data circuitry 13 of FIG. 2 and may include a mapping of gray levels to corresponding voltage levels for image data signals D produced by data circuitry 13.

During pixel display operations, data D is loaded into the display pixels of a pixel row by enabling switch SW1. The data loading process, which is sometimes referred to as data programming, takes place during a programming period. In a color display, programming may involve demultiplexing data and loading demultiplexed data into red, green, and blue pixels (e.g., pixel 22 may be a red pixel, as green pixel, or a blue pixel).

Following programming (i.e., after expiration of a programming period), the display pixels of the row may be used to emit light. The period of time during which the display pixels are being used to emit light (i.e., the time during which light-emitting diodes 30 emit light 40) is sometimes referred to as an emission period.

Prior to pixel display operations, compensation operations may be performed. The compensation operations may be performed, for example, at startup of the display or periodically. Compensation operations using compensation circuitry of FIG. 2 are illustrated in the timing diagram of FIG. 4.

During an initialization phase (Init) between times T1 and T2, pixel 22 is initialized to a known state. Data demultiplexer 20 is enabled (DATA_DEMUX is ON) and configured to electrically couple data circuitry 13 to data line 26 that is connected to pixel 22 of FIG. 3. Data circuitry drives data line 26 with signal D having reference voltage VREF and signal SCAN1 is asserted (e.g., logic one) to enable switch SW1, Which passes reference voltage VREF to node NODE2. Switching circuitry 21 that demultiplexes bias voltage VINI is enabled (VINI_DEMUX is ON) and configured to electrically couple bias circuitry 2 to pixel 22 of FIG. 3. Bias circuitry 27 provides bias voltage VINI having a Voltage that is less than VREF (e.g., VINI may be a negative voltage such as −2 volts or −3 volts). Signal SCAN2 is asserted to enable switch SW2, which passes bias voltage VINI to node NODE3. Signal EM is de-asserted to disable switch SW3 to help ensure that charge is not drained from capacitor CST1.

During sampling phase between times T2 and T3, demultiplexer 21 may be configured to electrically disconnect pixel 22 from bias circuitry 27 (INI_DEMUX is OFF). Signal SCAN2 may be deasserted to disconnect node NODE3 from bias circuitry 27. Signal EM is asserted to enable current flow through switch SW3 and transistor TD. Transistor TD pulls the voltage at node NODE3 to one transistor threshold voltage less than the gate voltage of transistor TD (i.e., VREF-VTH). At this voltage, transistor TD may be disabled as the gate to source voltage of transistor TD has reached the threshold voltage of transistor TD. At the end of the sampling phase, the voltage at node NODE2 is VREF and the voltage at node NODE3 is VREF-VTH. Accordingly, the voltage across capacitor CST1 is VTH. In other words, the threshold voltage of transistor TD is sampled by capacitor CST1.

During the pre-charge phase between times T3 and T4, pixel 22 and sense circuitry 25 may be prepared for sensing the transistor threshold voltage stored at capacitor CST1. Data demultiplexer 20 may be configured to electrically disconnect pixel 22 from data circuitry 13 (DATA_DEMUX is OFF). Signal SCAN1 may be deasserted to electrically disconnect node NODE2 from data line 26 (i.e., NODE2 is floating). Signal EM may be deasserted to turn off switch SW3. Compensation circuitry 17 may assert control signal FB to enable switch SWFB in an electrical feedback path at amplifier 42. Accordingly, amplifier 42 drives the path 23 with bias voltage VINI via the feedback path through switch SWFB. Demultiplexer 21 is configured to pass the bias voltage to pixel 22. Signal SCAN2 is asserted to enable switch SW2 to pass the bias voltage to node NODE3. Node NODE2 is pulled down to a voltage equal to the bias voltage added to the voltage sampled across capacitor CST1 (i.e., VINI+VTH). Voltage VTH stored at capacitor CST1 is maintained during the pre-charge phase. In other words, the charge stored at capacitor CST1 is maintained.

During the evaluation phase between times T4 and T5, sense circuitry 25 may be operated to sense the transistor threshold voltage stored at capacitor CST1. Data circuitry is configured to drive data signal D with a ground voltage (GND) while data demultiplexer 20 is configured to route the ground voltage to pixel 22 via path 26. Signal SCAN1 is asserted to enable switch SW1, which passes the ground voltage to node NODE2. Sense circuitry 25 may be placed in a sensing mode by deasserting control signal FB to disable switch SWFB. During the evaluation phase, the voltage across capacitor CST1 changes to VINI-GND (i.e., the amount of charge stored at capacitor CST1 changes). Due to charge conservation, charge is transferred to capacitor CFB of sense circuitry 25 and the output voltage of sense circuitry 25 at the end of the evaluation phase (e.g., at time T5) is equal to −VTH.

In particular, during the precharge phase (T3-T4), transistor threshold voltage VTH is stored across capacitor CST1 and the corresponding charge Q(CST1) is equal to the capacitance of capacitor CST1 (referred to herein as C(CST1)) multiplied by VTH. In other words, Q(CST1)=C(CST1)*VTH.

During the evaluation phase (T4-T5), the voltage across capacitor CST1 is changed to negative VINI (i.e., the voltage at NODE2−the voltage at NODE3). The charge that is now stored by capacitor CST1 is equal to the capacitance of capacitor CST1 multiplied by negative VINI (i.e., Q(CST1)=C(CST1)*−VINI). The difference in charge stored at capacitor CST1 is equal to the charge stored during precharge minus the charge that is now stored during evaluation. In other words, ΔQ(CST1)=(C(CST1)*VTH-C(CST1)*−VINI=C(CST1)*(VTH+VINI).

Due to charge conservation, the difference in stored charge is transferred to feedback capacitor CFB and adjusts accordingly the output voltage of amplifier 44. The difference in output voltage (ΔVO) between the precharge and evaluation phases is equal to the amount of charge transferred. In other words, the precharge phase output voltage minus the evaluation phase output voltage is equal to ΔQ(CST1)/CFB. Since the precharge phase output voltage was precharged to VINI and ΔQ(CST1)=CST1*(VTH+VINI), the evaluation phase output voltage is equal to VINI−ΔQ(CST1)/CFB=CST1/CFB*(VINI-VTH-VINI)=−CST1/CFB*VTH. The capacitance of CFB may be configured to be equal to the capacitance of CST1, and therefore the evaluation phase output voltage is equal to −VTH.

Figure 5:
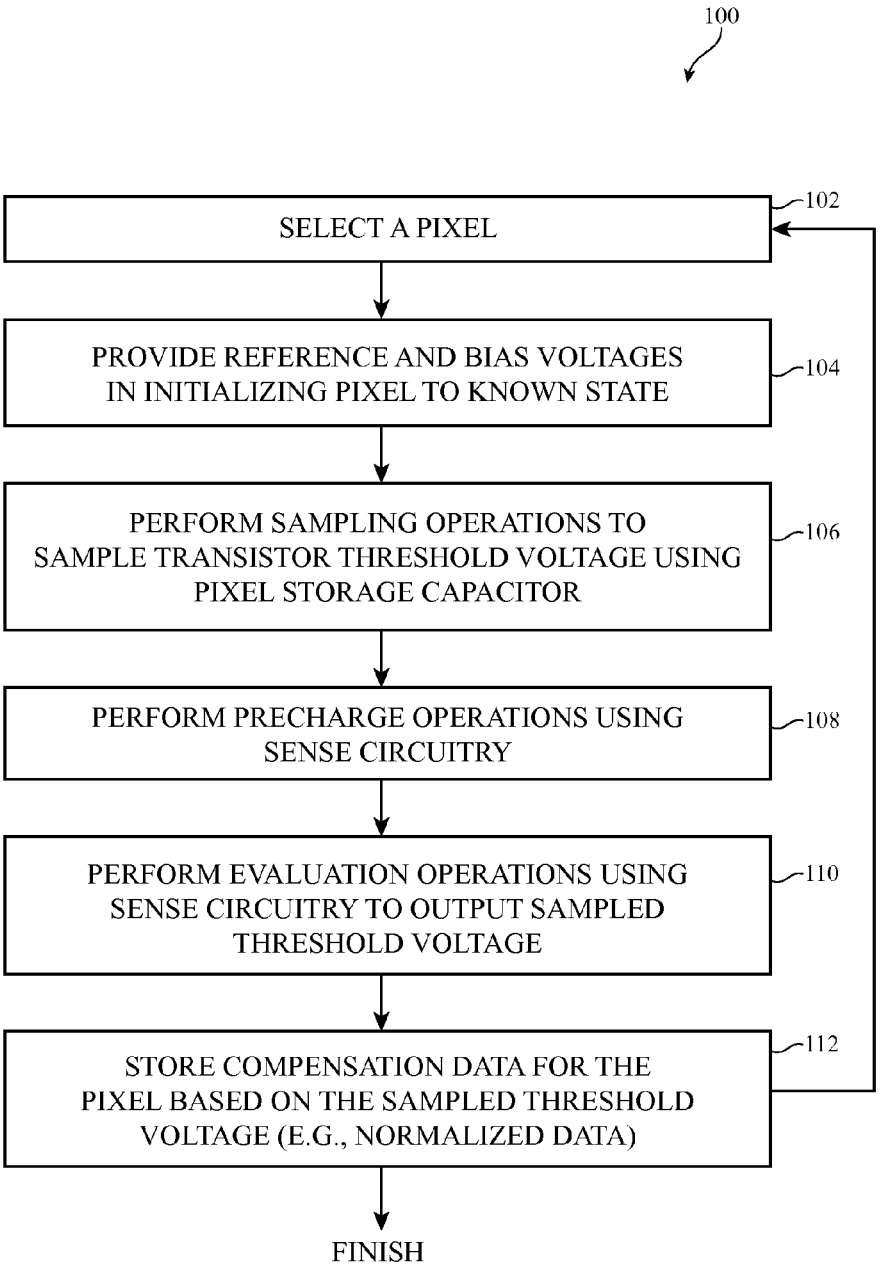
FIG. 5 is a flow chart of illustrative steps that may be performed using compensation circuit to generate compensation data for variations in transistor threshold voltage in accordance with an embodiment.

The threshold voltage sensing operations of FIG. 3 may be performed for multiple pixels 22 in a display. FIG. 5 is a flow chart 100 of illustrative steps that may be performed using compensation circuitry to generate compensation data that may help to correct for transistor variations during display operations.

During step 102, the compensation circuitry may select a pixel of the display for performing compensation operations.

Figure 4:
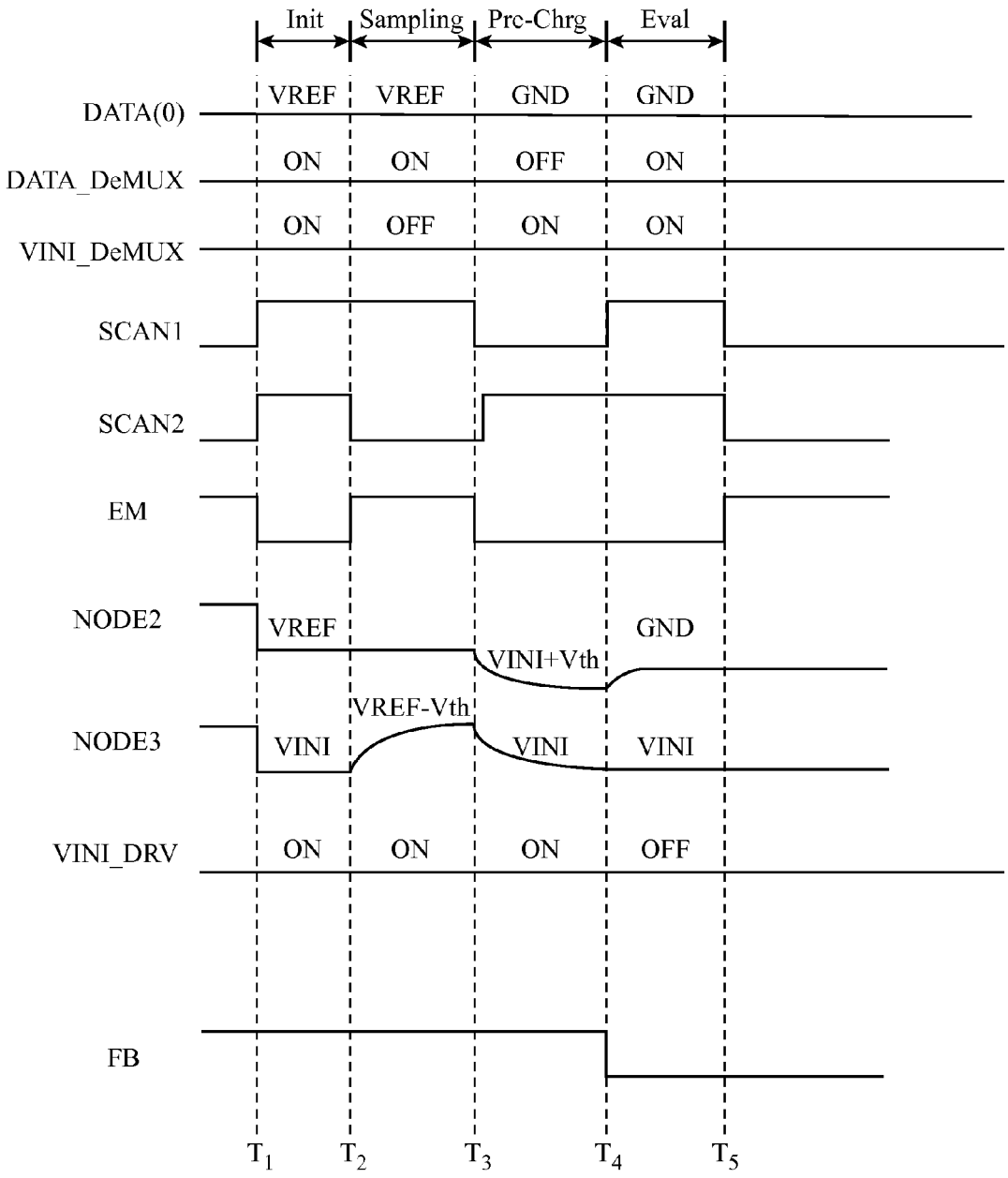
FIG. 4 is a timing diagram illustrating transistor voltage sensing operations that may be performed by compensation circuitry in accordance with an embodiment.

During step 104, the compensation circuitry may perform initialization steps during an initialization phase (e.g., between times T1 and T2 of FIG. 4). The compensation circuitry may provide tor may control data circuitry to provide) reference and bias voltages to nodes of the selected pixel using demultiplexing circuitry. As an example, bias circuitry, data circuitry, and/or sense circuitry may be used to provide the reference and bias voltages to the selected pixel in order to prepare the pixel for transistor threshold voltage sampling.

During step 106, the compensation circuitry may perform sampling operations during a sampling phase to capture a transistor threshold voltage of the pixel. For example, the threshold voltage of current source transistor TD may be sampled on capacitor CST1 of pixel 22 during the sampling phase between times T2 and T3 as shown in FIG. 4.

During step 108, the compensation circuitry may perform precharge operations during a precharge phase. The precharge operations may be performed to precharge pixel nodes and sense circuitry nodes to desired values in preparation for sensing the sampled threshold voltage with the sense circuitry. In the example of FIG. 4, pixel nodes NODE2 and NODE3 and the sense output may be precharged during the precharge phase between times T3 and T4 while maintaining the sampled threshold voltage across capacitor CST1.

During step 110, the compensation circuitry may perform evaluation operations during an evaluation phase. During the evaluation phase, sense circuitry at the compensation circuitry may be configured to transfer at least a portion of charge stored at the pixel to the sense circuitry. For example, feedback switch SWFB at sense circuitry 25 of FIG. 4 may be disabled as shown during the evaluation phase of FIG. 4 (between times T4 and T5) so that a portion of charge stored at pixel capacitor CST1 is transferred to feedback capacitor CFB. The transferred portion of charge corresponds to a change in output voltage of the sense circuitry from a precharged voltage to the sampled transistor threshold voltage.

During step 112, the compensation circuitry may generate compensation data for the pixel based on the output voltage of the sense circuitry. In the example of FIG. 3, compensation circuitry 17 may use comparator 244 and gamma block 44 to generate compensation data. In this scenario, control circuitry 248 may provide digital input data to gamma block 46 to sweep the output of gamma block 244 across all possible analog gray level voltages. Control circuitry 248 may monitor the output of comparator 244 to determine which analog gray level voltage matches the threshold voltage (e.g., when the output of comparator 244 inverts when sweeping through the analog gray level voltages). In response to identifying which analog gray level voltage matches the threshold voltage, control circuitry 248 may identify and store the corresponding digital input data that was provided to the gamma block in generating that analog gray level voltage. The identified digital input data digitally represents the magnitude of the analog transistor threshold voltage of the pixel. Control circuitry 248 may then store the digital representation of the threshold voltage in storage 29 (e.g., in an SRAM array).

The example in which comparator 244 and gamma block 44 are used in analog-to-digital conversion of a sensed transistor threshold voltage is merely illustrative. If desired, compensation circuitry may include any analog-to-digital circuitry that is used to convert a sensed transistor threshold voltage to a digital value.

If untested pixels remain at the end of step 112, the operations of flow chart 100 may return to step 102 to select and generate compensation data for the remaining untested pixels. If compensation data has been generated for all pixels in the display, the operations of flow chart 100 may be complete.

If desired, the compensation data stored in storage may be normalized to a reference threshold voltage value (e.g., a target threshold voltage value from which transistors variations cause deviations). For example, the control circuitry may store only the difference between the compensation data of each pixel and the target threshold voltage value. Such an arrangement may help to reduce storage requirements, as the normalized compensation data may be stored using fewer bits.

The example of FIG. 5 in which each pixel of a display is tested individually to generate compensation data is merely illustrative. If desired, compensation data may be generated for groups of pixels. For example, demultiplexing circuitry 21 of FIG. 2 may electrically couple compensation circuitry to groups of pixels 22 in display 14 simultaneously. In this scenario, threshold voltage sensing operations may be performed on each of the pixels in the group simultaneously. The threshold voltages may be measured in a summing arrangement, because charge transfer during the threshold voltage sensing operations to capacitor CFB may be the sum of charges from capacitor CST1 at each of the pixels of the group.

Compensation circuitry may also be used to help determine the appropriate capacitance of feedback capacitor CFB to match with internal pixel storage capacitance CST1. For example, feedback capacitor CFB may be a tunable (adjustable) capacitor such as a varactor or other tunable capacitor. In this scenario, compensation circuitry may calibrate a control signal provided to the tunable capacitor using similar steps used in sensing transistor threshold voltage. Feedback capacitor calibration steps are shown in the illustrative flow chart 120 of FIG. 6.

During step 122, the compensation circuitry may perform calibration operations similar to threshold voltage sensing steps 104, 108, and 110 of FIG. 5 (e.g., initialization, precharge, and evaluation operations). During the initialization operations, the voltage across capacitor CST1 is initialized to VREF-VINI. During subsequent precharge and evaluation operations, the voltage across capacitor CSST1 may be transferred to the sense circuitry output if the capacitance of capacitor CST1 is equal to the capacitance of feedback capacitor CFB (e.g., due to charge conservation). If the capacitances do not match, a different voltage may be produced at the output of the sense circuitry.

During step 124, the compensation circuitry may determine whether the sense circuitry output voltage matches a reference voltage value. For example, the compensation circuitry may supply reference voltage VREF-VINI to an input of comparator 244 and control circuitry 248 may determine whether the comparator output indicates that the sense circuitry output voltage matches the reference voltage. If the sense circuitry output voltage matches the reference voltage, the current configuration of feedback capacitor CFB passes testing and calibration operations are complete. If the sense circuitry output voltage does not match the reference voltage, the current configuration of feedback capacitor CFB fails testing and the control circuitry may adjust the value of the feedback capacitor during step 126 (e.g., by adjusting the control signal to the feedback capacitor). The process may then return to step 122 to test the updated configuration of the feedback capacitor.

Figure 7:
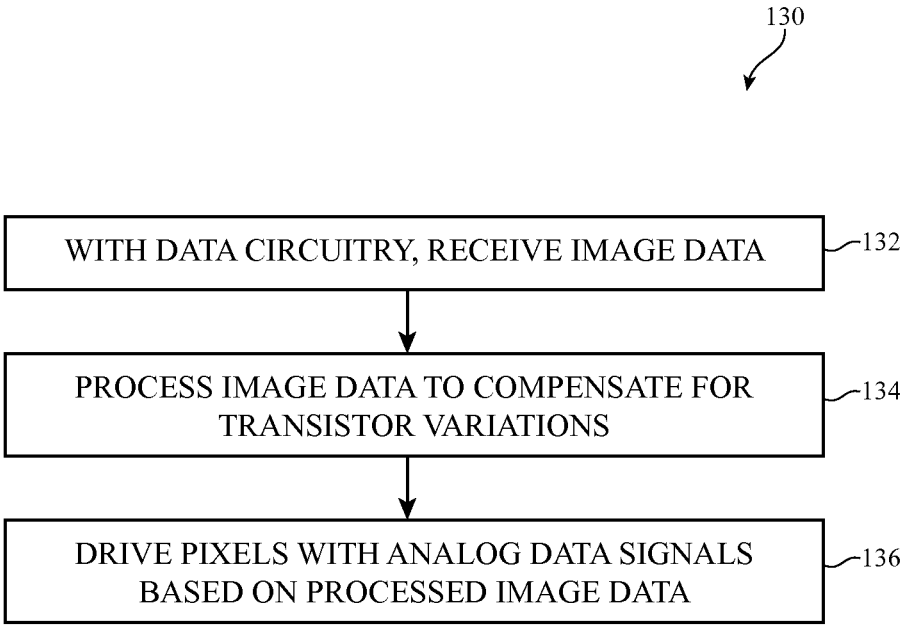
FIG. 7 is a flow chart of illustrative steps that may be performed by data circuitry to use compensation data in driving display pixels in accordance with an embodiment.

FIG. 7 is a flow chart 130 of illustrative steps that may be performed by data circuitry such as data circuitry 13 of FIG. 2 in using stored compensation data to generate data signals for pixels of a display.

During step 132, the data circuitry may receive digital image data to be displayed (e.g., from a processor such as a central processing unit).

During step 134, the data circuitry may process the digital image data to compensate for transistor variations. For example, the data circuitry may retrieve compensation offset data from storage and add the compensation offset data to the digital image data. As an example, the compensation offset data may be per-pixel offset data or may correspond to groups of pixels.

During step 136, the data circuitry may drive the pixels of the display with analog data signals generated based on the compensated image data. For example, the compensated image data may be provided to a control input of a multiplexer that selects between analog gray level voltages provided by a gamma block based on the compensated image data.

Figure 6:
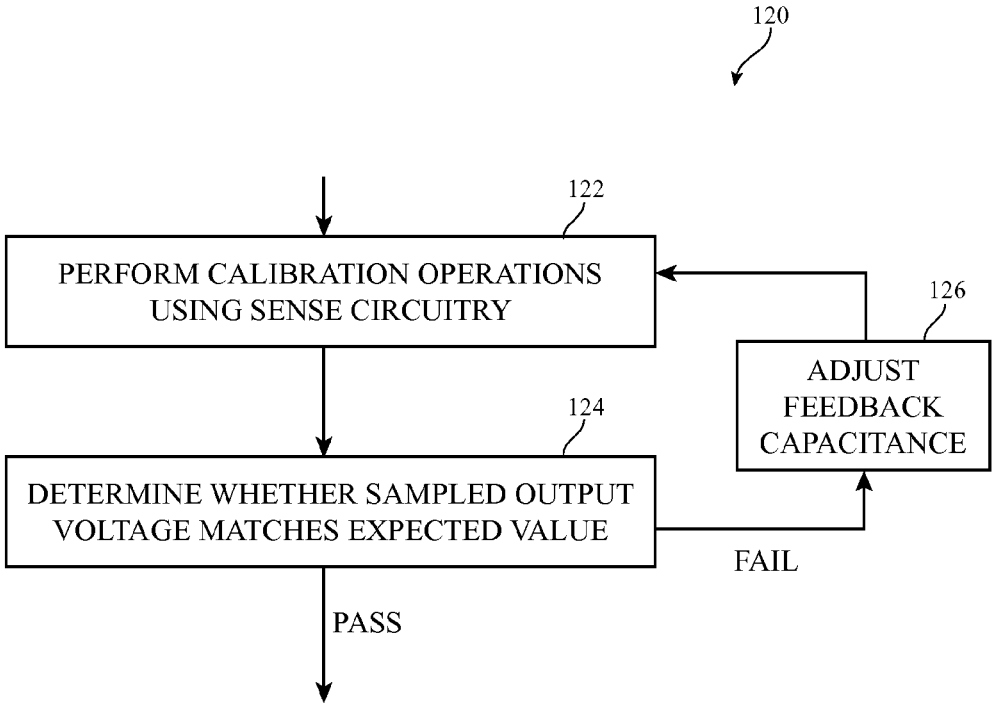
FIG. 6 is a flow chart of illustrative steps that may be performed using compensation circuitry to calibrate sense circuitry for display pixels in accordance with an embodiment.

The operations described in FIGS. 5-7 allow for compensation data to be generated prior to display operations (e.g., during hoot-up, periodically, during manufacturing, or at any desired time). This may help to reduce the amount of time required to display image data using data circuitry (e.g., because the compensation data has already been generated).

Figure 8:
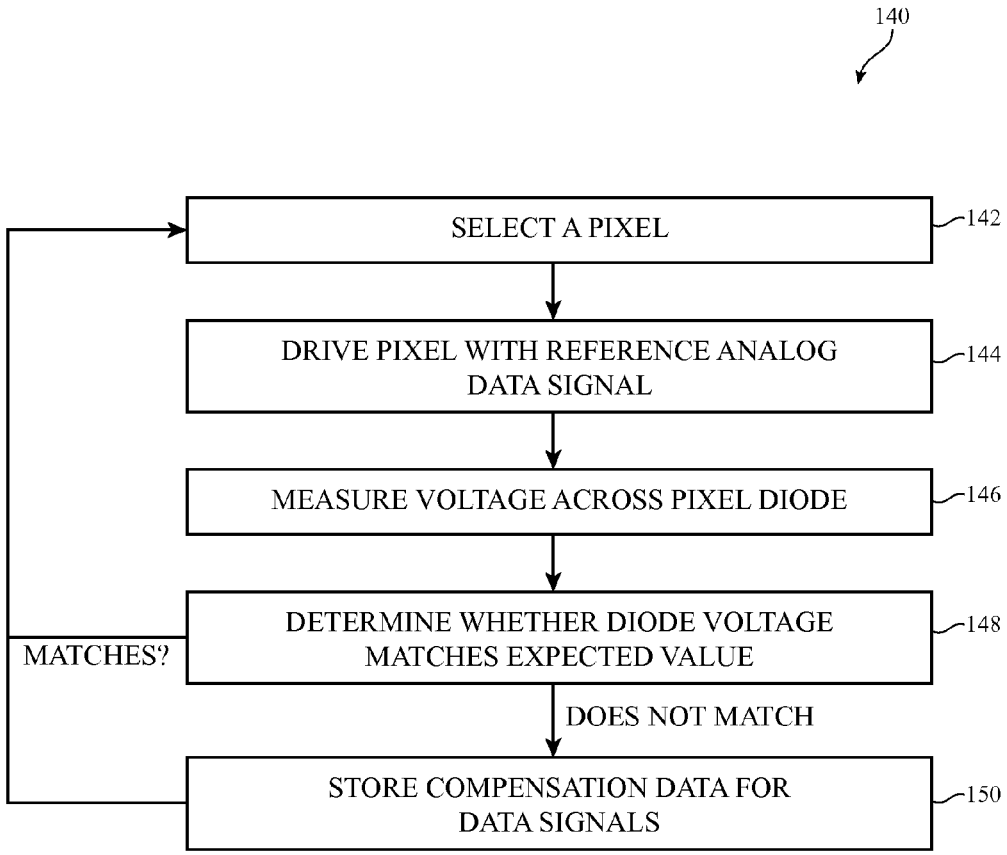
FIG. 8 is allow chart of illustrative steps that may be performed using compensation circuitry to generate compensation data to help accommodate variations due to transistor aging in accordance with an embodiment.

Transistors may experience aging over time that reduces the capability of the transistors to produce current. For example, transistor TD of pixel 22 of FIG. 3 may experience aging that reduces the amount of current sourced by the transistor for any given input voltage. Compensation operations performed by compensation circuitry 17 may be used to compensate for transistor aging. FIG. 8 shows a flow chart 140 of illustrative steps that may be performed using compensation circuitry to help compensate for transistor aging.

During step 142, the compensation circuitry may select a pixel for compensation.

During step 144, data circuitry may drive the selected pixel with a reference voltage on a data line. The reference voltage is routed to transistor TD, which sources current for the light-emitting diode. The amount of current through the diode corresponds to a respective voltage across the diode.

During step 146, the compensation circuitry may measure the voltage across the diode. For example, the compensation circuitry may include a comparator that compares the voltage across the diode to an expected diode voltage corresponding to the reference voltage on the data line of the pixel.

During step 148, the compensation circuitry may determine whether the measured diode voltage matches the expected diode voltage. In response to determining that the measured diode voltage matches the expected diode voltage, the process may return to step 142 to generate aging compensation data for any remaining untested pixels. In response to determining that the measured diode voltage fails to match the expected diode voltage, the compensation circuitry may generate aging compensation data to compensate for the mismatch. For example, if the measured diode voltage is less than the expected diode voltage, than the current flow through the diode is lower than expected and the compensation circuitry may generate compensation data that increases the voltage of data signals provided to the selected pixel (e.g., to increase the current flow through the pixel). The aging compensation data may be stored and used in processing image data similarly to transistor threshold compensation data. If desired, the aging compensation data may be combined with the transistor threshold compensation data and stored as combined offset values in storage.

The foregoing is merely illustrative and various modifications can be made by those skilled in the art without departing from the scope and spirit of the described embodiments. The foregoing embodiments may be implemented individually or in any combination.

What is claimed is:

1. A method of operating light-emitting diode display having pixels, the method comprising:

with compensation circuitry, measuring a transistor threshold voltage of at least one pixel of the display;

with the compensation circuitry, generating compensation data based on the measured transistor threshold voltage;

with circuitry, receiving image data; and with the circuitry, processing the received image data along with the compensation data to generate analog data signals for the at least one pixel of the display, wherein the at least one pixel of the display comprises a current source transistor coupled to a light-emitting diode and wherein measuring the transistor threshold voltage comprises:

sampling the transistor threshold voltage onto a capacitor coupled between gate and source terminals of the current source transistor, wherein the compensation circuitry comprises sense circuitry having an amplifier and a feedback capacitor coupled in a feedback loop between a first input and an output of the amplifier.

2. The method defined in claim 1, wherein a second input of the amplifier receives a bias voltage, and wherein measuring the transistor threshold voltage further comprises:

precharging the input and the output of the amplifier and the gate and source terminals of the current source transistor.

3. The method defined in claim 2 wherein a feedback switch is coupled between the input and the output of the amplifier and wherein measuring the transistor threshold voltage further comprises:

opening the feedback switch to transfer charge between the capacitor and the feedback capacitor, wherein the output of the amplifier has a voltage equal in magnitude to the transistor threshold voltage.

4. The method defined in claim 3 wherein generating the compensation data comprises generating the compensation data based on the voltage at the output of the amplifier.

5. The method defined in claim 4 wherein the compensation circuitry further comprises control circuitry and a comparator, the method further comprising:

with the comparator, comparing a plurality of analog gray level voltages to the voltage at the output of the amplifier, wherein each analog gray level voltage of the plurality of analog gray level voltages has a corresponding digital data value; and with the control circuitry, determining which analog gray level voltage and corresponding digital data value matches the voltage at the output of the amplifier.

6. The method defined in claim 5 wherein generating the compensation data based on the measured transistor threshold voltage comprises:

with the control circuitry, storing the digital data value that matches the voltage at the output of the amplifier as the compensation data.

7. The method defined in claim 5 wherein generating the compensation data based on the measured transistor threshold voltage comprises:

with the control circuitry, normalizing the digital data value that matches the voltage at the output of the amplifier across multiple pixels of the display; and with the control circuitry, storing the normalized digital data value as the compensation data.

8. The method defined in claim 4 wherein the compensation data comprises offset data and wherein processing the received image data along with the compensation data to generate the analog data signals for the at least one pixel of the display comprises:

summing the offset data and the received image data to produce a summed digital value.

9. A method of operating a light-emitting diode display having a plurality of pixels, wherein each pixel includes a current source transistor, a light-emitting diode, and a capacitor coupled between source and gate terminals of the current source transistor, the method comprising:

selecting a pixel;

with demultiplexing circuitry, electrically coupling the selected pixel to sense circuitry;

for the selected pixel, storing a transistor threshold voltage of the current source transistor across the capacitor using the current source transistor;

with the sense circuitry, measuring the transistor threshold voltage that is stored across the capacitor, wherein the sense circuitry comprises an amplifier having an input coupled to the demultiplexing circuitry and an output coupled to the input through a feedback switch; and after electrically coupling the selected pixel to the sense circuitry, disabling the feedback switch.

10. The method defined in claim 9 further comprising:

with analog-to-digital converter circuitry, converting the measured transistor threshold voltage to a digital value;

with data circuitry, receiving digital image data; and with the data circuitry, generating an analog data signal for the selected pixel based on the received digital image data and the digital value.

11. The method defined in claim 10, further comprising:

with storage circuitry, storing the digital value.

12. The method defined in claim 10, wherein generating the analog data signal comprises adding offset data to the digital image data.

13. The method defined in claim 9, wherein each pixel further includes a switch coupled between the capacitor and a data line, the method further comprising:

after electrically coupling the selected pixel to the sense circuitry, enabling the switch in the selected pixel to pass a ground voltage to the capacitor in the selected pixel.

14. The method defined in claim 13, wherein each pixel further includes an additional switch coupled between the current source transistor and a power supply terminal, the method further comprising:

disabling the additional switch in the selected pixel while the switch is enabled to pass the ground voltage to the capacitor in the selected pixel.

15. The method defined in claim 14, wherein each pixel further includes a third switch coupled between the light-emitting diode and the sense circuitry, the method further comprising:

enabling the third switch in the selected pixel while the additional switch is disabled and while the switch is enabled in the selected pixel.

16. The method defined in claim 9, wherein each pixel further includes a switch coupled between the capacitor and a data line, the method further comprising:

after electrically coupling the selected pixel to the sense circuitry, enabling the switch in the selected pixel to pass a ground voltage to the capacitor in the selected pixel while the feedback switch is disabled.

17. The method defined in claim 16 further comprising:

with converter circuitry, converting the measured transistor threshold voltage to a digital value;

with data circuitry, receiving digital image data; and with the data circuitry, generating an analog data signal for the selected pixel based on the received digital image data and the digital value.

18. The method defined in claim 17, further comprising:

driving the selected pixel based on the generated analog data signal.

* * * * *